US005230234A

United States Patent [19]

Fuhrman

[11] Patent Number: 5,230,234

[45] Date of Patent: Jul. 27, 1993

[54] METHOD OF MAKING ROLL-FINISHED GEARS

[75] Inventor: William J. Fuhrman, Bloomfield Hills, Mich.

[73] Assignee: Ford Motor Company, Dearborn, Mich.

[21] Appl. No.: 880,920

[22] Filed: May 11, 1992

[51] Int. Cl.[5] ..... B21H 5/02

[52] U.S. Cl. ..... 72/70; 72/108

[58] Field of Search ..... 72/70, 108; 29/406, 29/893.32

[56] References Cited

U.S. PATENT DOCUMENTS 3,362,059 1/1968 Di Ponio et al. .
3,599,463 12/1968 Sennstrom .

FOREIGN PATENT DOCUMENTS 1611530 12/1990 U.S.S.R. ..... 29/893.32
2157201 10/1985 United Kingdom ..... 29/406

*Primary Examiner*—Lowell A. Larson

*Attorney, Agent, or Firm*—Joseph W. Malleck; Roger L. May

[57] ABSTRACT

A method of preparing a gear blank for roll-finishing, essentially comprising the step of: while supporting a gear blank with pitch-line chucking, finish-sizing the central axial opening of the gear blank to a desired concentricity to promote accurate subsequent roll-finishing. Also, a method of making roll-finished gears, comprising: (a) preparing a near-net-shape gear blank, with external gear teeth and a central axial opening, by intimately engaging and supporting the gear blank between two opposing roll-finishing gear dies, without teeth finishing pressure; (b) finish-sizing the sides of said axial opening to attain a concentricity between the gear blank's intended tooth pitch circle and said sized sides that is within the range of 0.001 inch TIR; and (c) inserting a snugly fitting arbor into said opening and completing roll-finishing of the gear blank by progressively bringing the roll-finishing dies together to exert teeth finishing pressure and rotating said dies to form the desired gear teeth on said gear blank.

7 Claims, 2 Drawing Sheets

METHOD OF MAKING ROLL-FINISHED GEARS

BACKGROUND OF THE INVENTION

1. Technical Field

This invention relates to the art of roll-finishing planet pinion or sun gears with precise concentricity and accurate formation of gear teeth, particularly helical gear tooth elements, and to adapting such roll-finishing to gear blanks initially prepared with less concentricity.

2. Discussion of the Prior Art

Roll-finishing external helical gear teeth has displaced, in some plants, other finishing techniques of gear generating that depend upon metal cutting. An advantage is gained by use of roll-finishing dies to attain a much quieter gear at minimal expense; this is particularly attractive for fine pitch automotive gearing used in automatic transmissions.

U.S. Pat. No. 3,362,059 is a pioneering patent directed to roll-finishing of gears using roller dies with involute sides having differing pressure angles on opposite sides of the die teeth; such patent is commonly assigned to the assignee of this invention. The above patented process has heretofore required an arbor to accurately locate and position the gear blank, internally and axially, while undergoing roll-finishing. This is and remains a most sensitive aspect of the process because it not only demands that the arbor be positioned in a precise station lying in a precise relation to the rolling dies, but also that the internal openings of the gear blank and dies have concentric surfaces about their supporting axes to assure a high degree of accuracy of the gear teeth.

A significant future for the roll-finishing process exists, if it can be applied to gear blanks previously formed to near-net-shape without machining but accompanied by slightly less accurately formed surfaces. But how can conventional roll-finishing be carried out if the internal bore of the gear blank is slightly inaccurate, thereby frustrating internal chucking. For example, either conventional or hot-forged near-net-shape powder metal gear blanks will have a pressed internal bore pitch diameter concentricity accuracy of about 0.004 inches as opposed to an accuracy achievable with gear blanks finish-machined to about 0.001 inches or better. Thus, the internal bore of such powder metal gear blanks will not possess the extreme accuracy of gear blanks hobbed or machine-cut, but, of course, will not suffer from the expense and lower productivity associated with hobbing or machining.

Less accurately and nonconcentrically formed gear blanks (either as a result of using a nonmachining forming process or as a result of poor machining) cannot be located and positioned by arbors if gear tooth accuracy is to be achieved by roll-finishing. U.S. Pat. No. 3,599,463 recognized this problem and observed that in larger gears it was exaggerated; it disclosed a solution that included separate but matching guide surfaces on the dies as well as the gear blank. This solution would not be helpful when attempting to adapt the roll-finishing process to gear blanks formed by near-net-shape techniques and their accompanying reduced accuracy.

SUMMARY OF THE INVENTION

This invention, in a first aspect, is a method of preparing a gear blank for roll-finishing, and essentially comprises the step of: while supporting a gear blank with dynamic pitch-line chucking, finish-sizing the central axial opening of the gear blank to a desired concentricity to promote accurate subsequent roll-finishing.

In a second aspect, the invention is a method of making roll-finished gears, comprising: (a) preparing a near-net-shape gear blank, with external gear teeth and a central axial opening, by intimately engaging and supporting the gear blank between two opposing roll-finishing gear dies, without teeth finishing pressure; (b) finish-sizing the sides of said axial opening to attain a concentricity between the gear blank's intended tooth pitch circle and said sized sides that is within the range of 0.0005"; and (c) inserting a snugly fitting arbor into said opening and completing roll-finishing of the gear blank by progressively bringing the roll-finishing dies together to exert teeth finishing pressure and rotating said dies to form the desired gear teeth on said gear blank.

"Near net shape" is used herein to mean semi-finished gear teeth as produced by hobbing, a powder metal process, or by cold extrusion, but without final size, crown, and surface finish; "intimate engagement" is used herein to mean snug, no-backlash contact; "pitch-line chucking" is used herein to mean the dynamic location and conjugate gear tooth action obtained while in intimate die-to-gear contact; "without teeth finishing pressure" is used herein to mean intimate metal-to-metal contact of die and workpiece teeth, such contact being without extrusion or metal deforming pressure.

Preferably, the external gear teeth are helical, and the sizing tool is preferably a rotary boring bar which is fed at a rate of about 0.001 inch per gear revolution.

Preferably, an indexible carousel turret may be used to feed the gear blanks to a station between the roll-finishing dies, which dies are moved into intimate engagement; a hollow sleeve is thrust against the side of the gear blank to restrict it to a location between the dies. After the turret is withdrawn, a sizing tool is inserted through the sleeve and through the central opening to concentrically finish the sides of the central opening.

DETAILED DESCRIPTION AND BEST MODE

Acceptable noise and durability requirements of automatic transmission planet pinion and sun gears mandate the need for precision control of all helical gear tooth elements, including pitch diameter-to-bore concentricity, throughout the manufacturing process. The typical process specification for concentricity before heat treatment is typically on the order of 0.001 inch TIR (total internal radius) maximum; this is not a major problem during conventional hobbing and subsequent green finishing by either shaving or rolling. But when a near-net-shape manufacturing process is used, because it is more cost competitive than hobbing, concentricity, in many cases, becomes a major feasibility concern. Use of conventional powder metal for lower-stressed gear applications is restricted by as-pressed concentricity of about 0.004 inches TIR at best. Thus, if cold extrusion by way of roll-finishing is desired, a precision-machined blank of 0.001 inch TIR is required, but eliminates near-net-shape processing in order to accommodate precision concentricity.

The unique method here disclosed introduces precision concentricity, while using a near-net-shape gear blank, by finish-boring the central opening of the workpiece gear on the rolling machine proper by exterior chucking, just prior to the rolling cycle.

Figure 1:
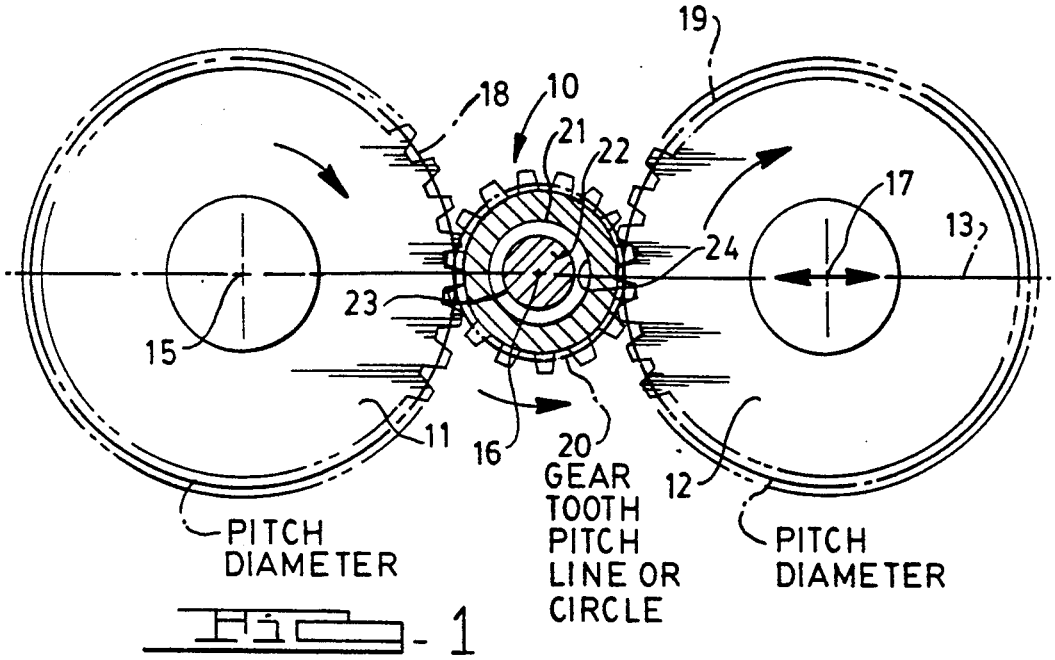
FIG. 1 is a diagramatic elevation view of a gear blank held in pitch line chucking by use of the opposed roll-finishing dies and undergoing finish-sizing by use of a boring tool.

A first aspect of this invention prepares a gear blank for roll-finishing and comprises essentially the following: while supporting a gear blank with pitch line chucking, the gear blank has its central axial opening finish-sized to a desired concentricity for promoting accurate subsequent roll-finishing. Such preparation intimately engages and locates the workpiece or gear blank 10 in a common plane 13 with the axes of two opposing circular roller dies 11 and 12, thus providing a rotating pitch line chucking arrangement as illustrated in FIG. 1 (axes 15, 16, and 17 are in common plane 13). The dies make contact, by way of their respective pitch-lines 18 and 19, with the gear blank pitch-line 20.

Die 11 can be stationary and die 12 can be movable to allow feed of axis 17 toward the die 11. Operationally, during a partial in-feed cycle, the workpiece is positioned in snug contact between the two opposing dies 11 and 12. A workpiece support mandrel or arbor 21 (shown in broken outline in FIG. 1) is retracted and a boring bar 22, carrying a cutting bit 23, is fed axially through the central opening or hole 24 at a predetermined rate, established to provide an appropriate surface-feed-per-minute for optimum machinability. Alternatively, a grinding wheel, end-cutting reamer, or carbide burr tool, powered by a high speed air motor, could be used in place of the boring bar to reduce cycle time, if essential.

As a second aspect, this invention comprehends a method of making roll-finished gears by the process of: (a) preparing a near-net-shape gear blank with external gear teeth and a central axial opening; (b) intimately engaging the gear blank between two opposing roll-finishing gear dies, having die teeth complementary to the near-net-shape teeth on said blank, the engagement being without teeth-finishing pressure and effective to exteriorly chuck the gear blank on the pitch diameter of the dies with high accuracy; (c) finish-sizing the sides of the axial opening of the gear blank while exteriorly chucked to attain a concentricity between the gear tooth pitch circle and the sized sides that is equal to or less than 0.001 inch; and (d) inserting a snugly fitting arbor into the sized opening while the workpiece is exteriorly chucked and completing roll-finishing of the gear blank by progressively bringing the roll-finishing dies together to exert teeth finishing pressure and thereby form the desired gear teeth on said gear blank.

As shown in FIG. 1, the axis of the single boring bar is coincident with the horizontal plane 13 of the die and workpiece axes. The boring bit 23 is located at the nine o'clock position of the workpiece as it engages the fixed-position roller die 11. In this orientation, any vertical displacement of the workpiece due to dynamic pitch line variability will not greatly influence opening 24 size and concentricity, both of which will be established by consistent wall thickness (boring bit-to-pitch line 20) control. A CNC pre-inspection of the pitch-line diameter and subsequent feedback to position the boring bar will reduce opening 24 size variability.

To prevent the introduction of boring chips into the otherwise exposed roll-finishing cycle, a retractable sleeve 25 at the outboard end 26 of the gear blank 10 will axially position the gear in proper position within the die width and additionally serve as a manifold through which machining chips (and pressurized coolant, if required) can be isolated from the rolling system.

As depicted in FIGS. 2–5, the above system can be incorporated into a turret-type fixture arrangement normally employed by high volume roll-finishing of automotive pinion and sun gears. Progressively, during continuous rotation of dies 11 and 12, a four-position turret 27 accommodates the following operations, each 90° clockwise of prior index position.

Figure 2:
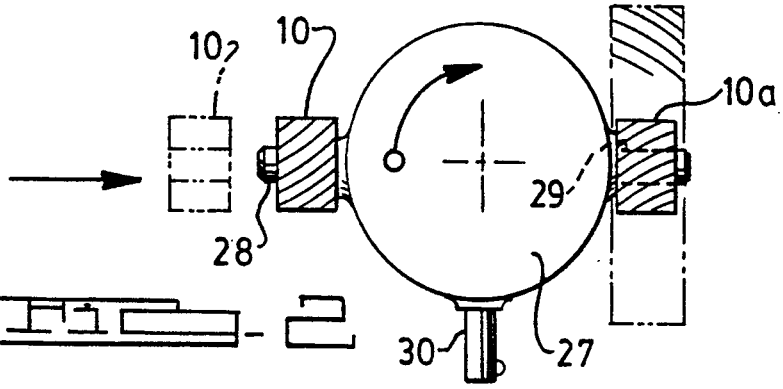
FIGS. 2-5 is a series of sequential diagrams illustrating the automatic indexing of a carousel turret to feed the gear blanks and permit finish-sizing to be followed by roll-finishing.
Figure 3:
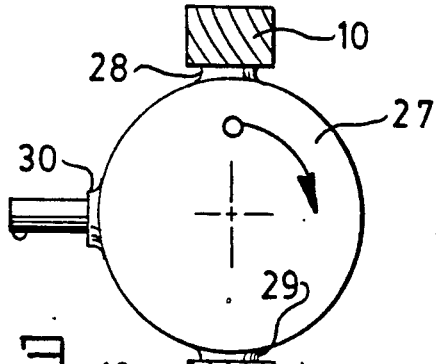
Figure 4:
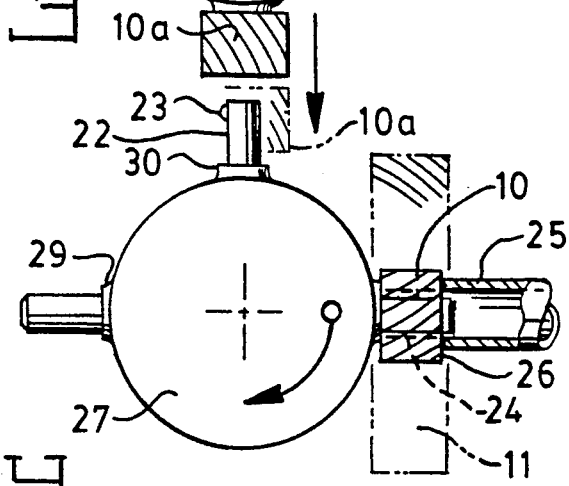
Figure 5:
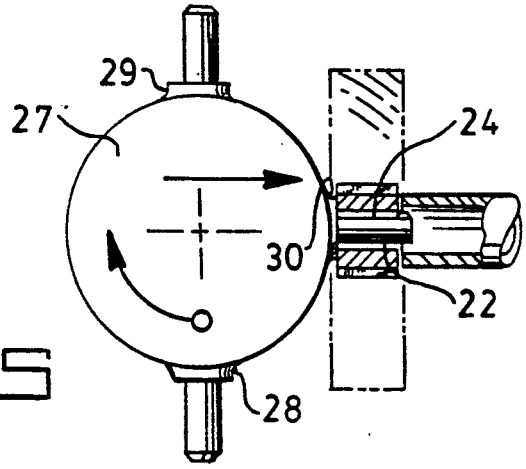

As shown in FIG. 2, a first operation comprises automatic loading of a new workpiece or gear blank 10 onto turret post 28. As shown in FIG. 3, the turret is turned clockwise 90° causing the worked gear blank 10*a* to be indexed downwardly and dropped from post 29 for unloading, while the new gear blank 10 is suspended in the upper transfer position on port 28. As shown in FIG. 4, the turret 27 is advanced another 90° to position the new gear blank 10 between the roller dies 11 and 12 and against the stop sleeve 25. The in-feed roller die 12 will be snugged up against the gear blank and the turret will be withdrawn along with withdrawal of the post 28 from the opening 24. As shown in FIG. 5, the boring bar 22 on turret post 30 is fed into the opening 24 of the gear blank to finish-machine the internal bore and then retracted when finish-sizing is complete. Finish-sizing is used herein to mean completely machining to clean up bore surface completely without evidence of original rough eccentric geometry Returning now to FIG. 2, the next operation is also shown. The post 29 is fed into the finish-sized opening 24 of blank 10 and the in-feed roller die is moved or advanced to a final depth to apply finishing pressure between the two roller dies, then the post 29 is retracted. As shown in FIG. 3, the last operation includes ejection of the finished bored and rolled gear from post 29 in its downward position by virtue of gravity.

Laboratory testing of a prototype bore/rolling system has demonstrated satisfactory results. Sample gear blanks with artificially produced PD-to-bore eccentricity as high as 0.009 inches TIR were improved by boring with pitch-line chucking to 0.0005 inches TIR and better, while maintaining adequate control of hole size, geometry, and surface-finishing during a 30-second boring cycle.

I claim:

1. A method of preparing a gear blank for roll-finishing helical teeth, comprising;

while supporting a gear blank with pitch-line chucking carried out by intimate conjugate gear tooth action between the pitch diameters of two externally toothed dies and a gear blank, finish-sizing said blank's central axial opening to a desired concentricity to promote accurate subsequent roll-finishing, said finish-sizing of said central opening being carried out by inserting a rotating boring bar into said opening at a slow axial feed rate.

2. A method of making roll-finished gears, comprising:

(a) preparing a near-net-shape gear blank with external gear teeth and a central axial opening (b) intimately engaging the gear blank between two opposing roll-finishing gear dies, having die teeth complementary to the near-net-shape teeth on said blank, said engagement being without teeth-finishing pressure and effective to exteriorly chuck said gear blank on the pitch diameter of said dies with high accuracy;

(c) finish-sizing the sides of said axial opening of said gear blank, while exteriorly chucked, to attain a concentricity between the gear tooth pitch circle and said sized sides that is equal to or less than 0.001 inch; and (d) inserting a snugly fitting arbor into the sized opening of the gear blank, while exteriorly chucked, and completing roll-finishing of the gear blank by progressively bringing the roll-finishing dies together to exert teeth finishing pressure and thereby form the desired gear teeth on said gear blank.

3. The method as in claim 2, in which said exterior chucking locates said blank with an accumulating accuracy of at least 0.001 inch.

4. The method as in claim 2, in which the axes or rotation of said dies and blank supported therebetween lie in a common plane.

5. The method as in claim 2, in which said external gear teeth are helical.

6. The method as in claim 2, which further comprises stationing a coaxial sleeve at the exposed side of said gear blank to contain sizing chips during step (b) and to restrain said blank against axial movement.

7. The method as in claim 2, in which said exterior chucking applies pressure to said gear blank equivalent to about 1000 pounds maximum machine cylinder pressure, and said gear teeth finishing pressure being about 25,000 pounds cylinder pressure.

* * * * *